US011103770B1

(12) United States Patent
Masek

(10) Patent No.: US 11,103,770 B1
(45) Date of Patent: Aug. 31, 2021

(54) IN THE BAG . . . TABLETOP GAME PIECE COLLECTION AND STORAGE DEVICE

(71) Applicant: Richard T Masek, San Diego, CA (US)

(72) Inventor: Richard T Masek, San Diego, CA (US)

( * ) Notice: Subject to any disclaimer, the term of this patent is extended or adjusted under 35 U.S.C. 154(b) by 0 days.

(21) Appl. No.: 17/303,342

(22) Filed: May 27, 2021

(51) Int. Cl.
*A63F 11/00* (2006.01)

(52) U.S. Cl.
CPC ... *A63F 11/0002* (2013.01); *A63F 2011/0004* (2013.01)

(58) Field of Classification Search
CPC ..... A63F 11/0002; A63F 2011/0004
USPC ..... 273/148 R
See application file for complete search history.

(56) References Cited

U.S. PATENT DOCUMENTS 1,077,968 A * 11/1913 Bisland ..... G07D 9/065 53/254
2,008,078 A * 7/1935 Martin ..... A47B 25/00 108/26
2,707,141 A * 4/1955 Witter ..... A47B 13/16 108/26
3,851,656 A * 12/1974 Haas ..... A63F 3/06 221/281
4,099,470 A * 7/1978 Cannon, Jr. ..... A47B 25/00 108/152
D287,035 S * 12/1986 Lewis ..... D21/392
5,207,425 A * 5/1993 Cohrs ..... A63F 11/0002 141/332
5,996,999 A * 12/1999 Casely ..... A63F 3/00895 273/148 R
7,815,153 B2 * 10/2010 Campbell ..... B65F 1/1415 248/99
8,015,927 B1 * 9/2011 Helline ..... A47B 13/16 108/26
8,584,888 B2 * 11/2013 Buerk ..... B65F 1/141 220/482

* cited by examiner

*Primary Examiner* — Michael D Dennis

(57) ABSTRACT

In The Bag (Tabletop Game Piece Collection and Storage) is a removable device for collecting and removing tiles or other game pieces directly from a playing surface tabletop into a detachable bag for continued play or storage. The invention slides onto the edge of a tabletop or other playing surface. A retaining arm engages the underside of the playing surface. Two adjustable arms extend onto the playing surface creating a channel through which the playing pieces can be gathered. After entering the channel, the pieces fall into a chute to which a removable bag is attached. Once all of the playing pieces are gathered into the bag, the bag is removed from the collection chute assembly and passed to the players to select their game pieces. The collection device may be removed from the table between rounds of play or for storage of the device and playing pieces.

1 Claim, 11 Drawing Sheets

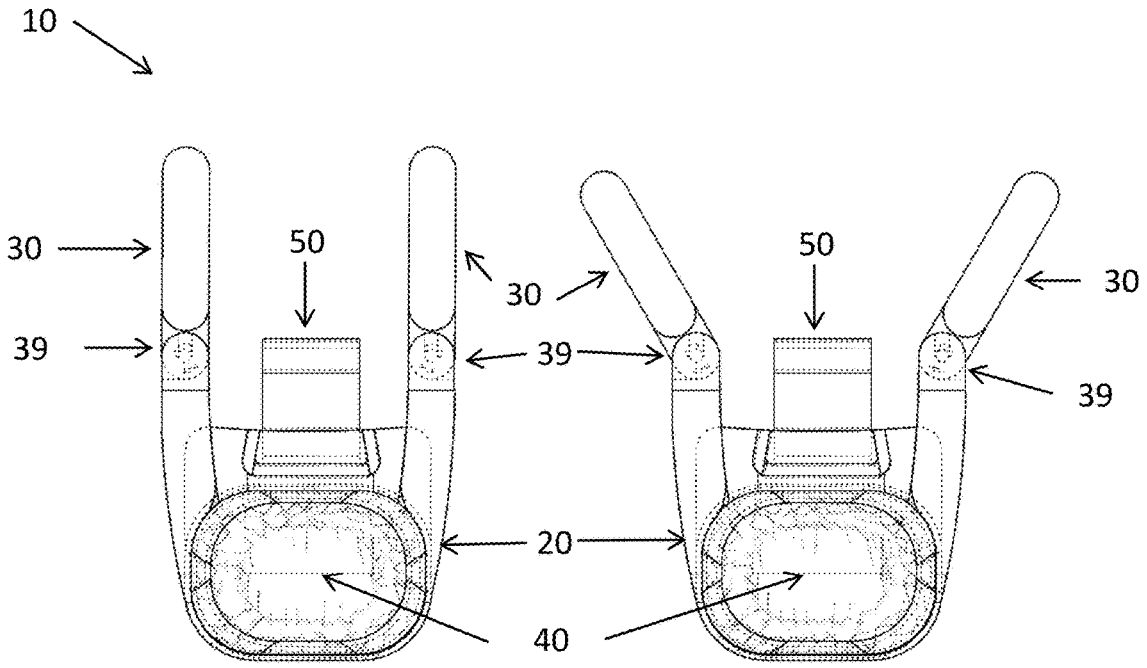
FIG. 4A
FIG. 4C
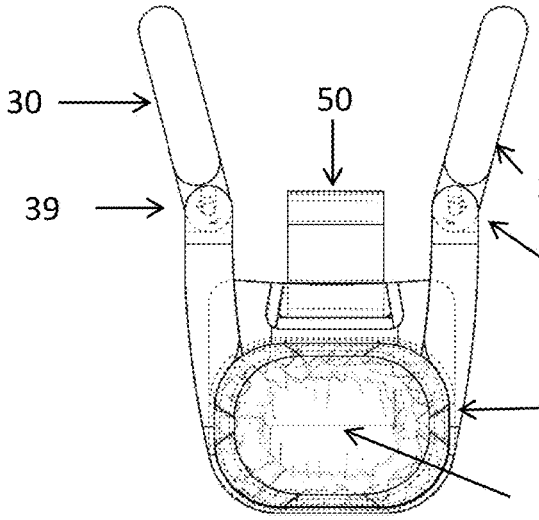
FIG. 4B
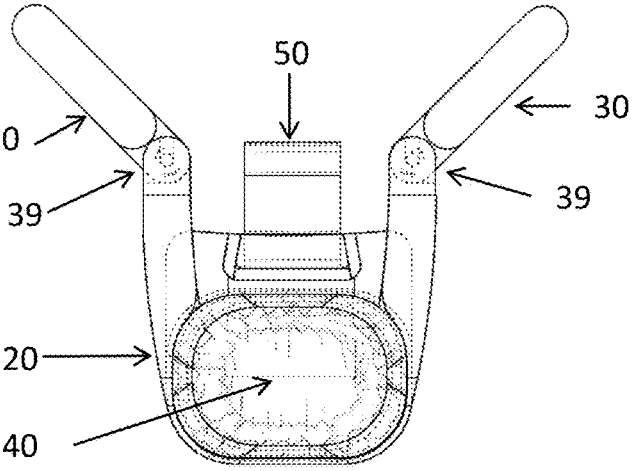
FIG. 4D

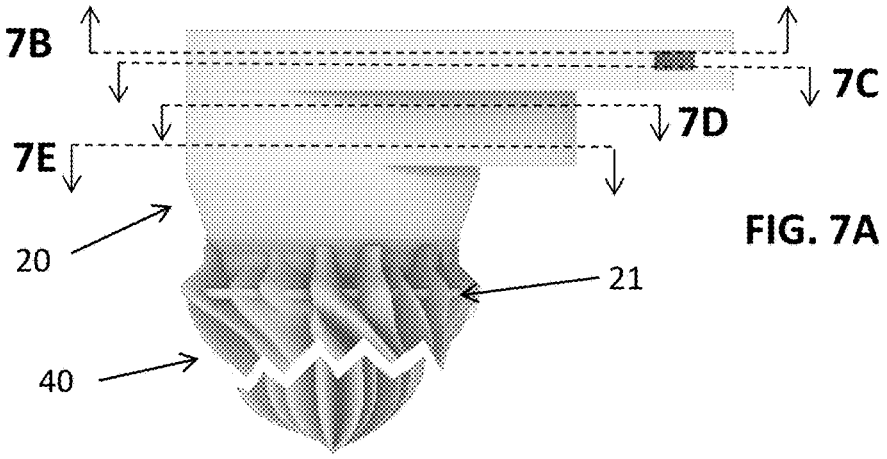
FIG. 7A
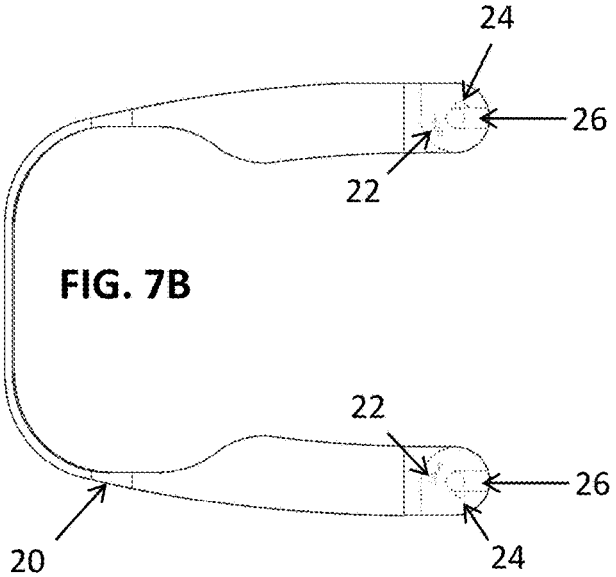
FIG. 7B
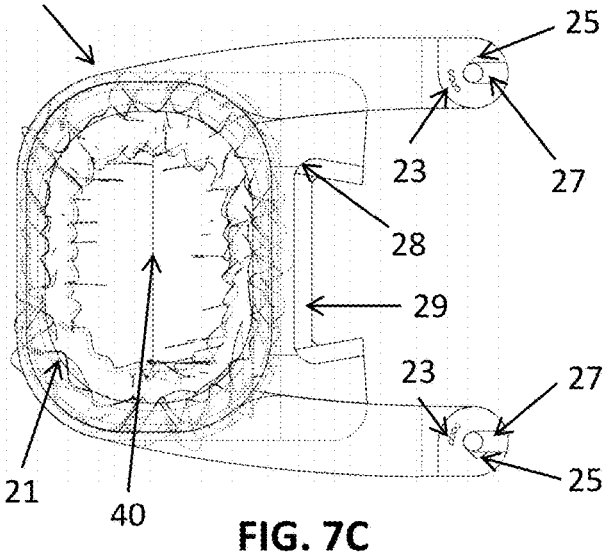
FIG. 7C
FIG. 7D
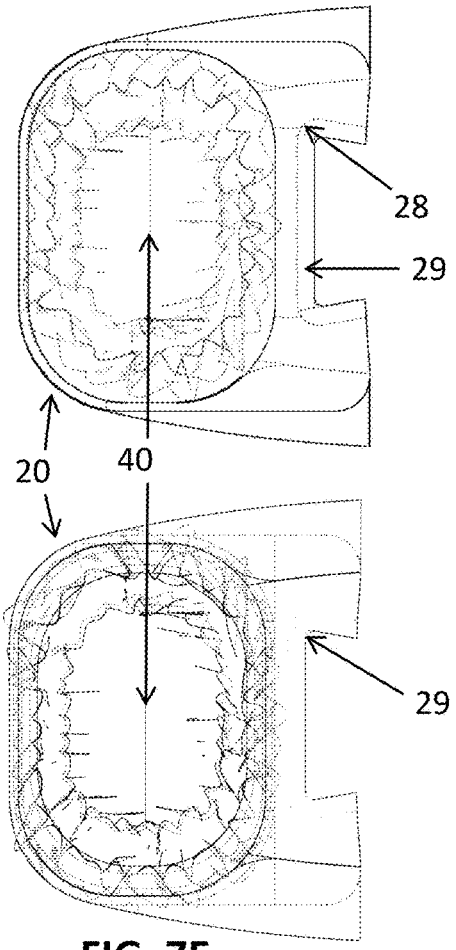
FIG. 7E

IN THE BAG . . . TABLETOP GAME PIECE COLLECTION AND STORAGE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

(1) Field of the Invention

This invention is within CPC A63F. Games available for entertainment have multiple playing pieces that become spread across the playing surface. These games include dominoes, word tile games such as Scrabble™, Mahjong, Legos™, jigsaw puzzles, and others. In tile based games, between rounds of play, the playing pieces are collected and removed from the playing surface for selection and gameplay.

The "boneyard" of playing tiles, as it is frequently referred to, requires turning each piece over to conceal the playing surface and can sometimes occupy a significant amount of space on the game table. This reduces the amount of space that players have for personal items on the game table. To facilitate play and create more room, some players prefer to collect the game pieces into a bag from which the tiles may be drawn. Collection of the tiles into the bag from the playing surface can be cumbersome, requiring picking up or stacking multiple pieces. This invention has been designed to simplify collection, game play and storage of the playing pieces.

(2) Description of Related Art Including Information Disclosed Under 37 CFR 1.97 And 1.98

None Found

BRIEF SUMMARY OF THE INVENTION

The invention provides a system for collecting and removing tile/s or other game pieces directly from the tabletop by funneling them directly into a removable bag for continued play or storage. The invention slides onto the edge of a tabletop or other playing surface, and against the rim of the table. A retaining arm engages the underside of the playing surface for stability. Two arms extend onto the playing surface creating a channel through which the playing pieces can be drawn and removed from the playing surface. After entering the channel, the pieces are funneled and fall into a chute to which a removable bag is attached. Once the playing pieces are gathered into the bag, the bag may be removed from the collection chute assembly and passed to the players to select their game pieces for continuation of play. The collection device may be removed from the table between rounds of play or for storage of the device and playing pieces.

BRIEF DESCRIPTION OF THE SEVERAL VIEWS OF THE DRAWING(S)

Features will be more readily understood from the following detailed descriptions of the various components of the invention and illustrated with the accompanying drawings which depict various aspects of the invention.

FIG. 1 shows three views of the assembled invention.

FIG. 2 shows three views of the collection chute assembly with the bag removed.

FIG. 3 shows three detail views of the collection bag.

FIG. 4 shows four top views of the assembled invention and demonstrates the adjustability of the collection arms.

FIG. 4A shows a view of parallel arms.

FIG. 4B shows a view arms at 15° of opening.

FIG. 4C shows a view arms at 30° of opening.

FIG. 4D shows a view arms at 45° of opening.

FIG. 5 shows the detail of the adjustable collection arms.

FIG. 6 shows side views of the collection chute assembly detailing the attachment of the adjustable collection arms and attachment of the collection bag.

FIG. 7 shows cross section views detailing the adjustable collection arm pivot joint and the attachment dovetail of the table top retention clips.

FIG. 7A shows the cross section regions identified in the subsequent figures.

FIG. 7B shows a detail view of the upper collection arm joint.

FIG. 7C shows a detail view of the lower collection arm joint, the collection bag placement and the table top retention clip connection dovetail.

FIG. 7D shows a detail view of the collection bag placement, the upper ledge of the table top retention clip connection dovetail.

FIG. 7E shows a detail view of the collection bag placement and the lower ledge of the table top retention clip connection dovetail.

FIG. 8 shows the detail of the interchangeable table top retention clips.

FIG. 9 shows the detail of the connection between the collection chute assembly and the interchangeable table top retention clips.

FIG. 10 shows the detail of attachment of the device to playing surfaces of varied thickness.

DETAILED DESCRIPTION OF THE INVENTION

Figure 1A:
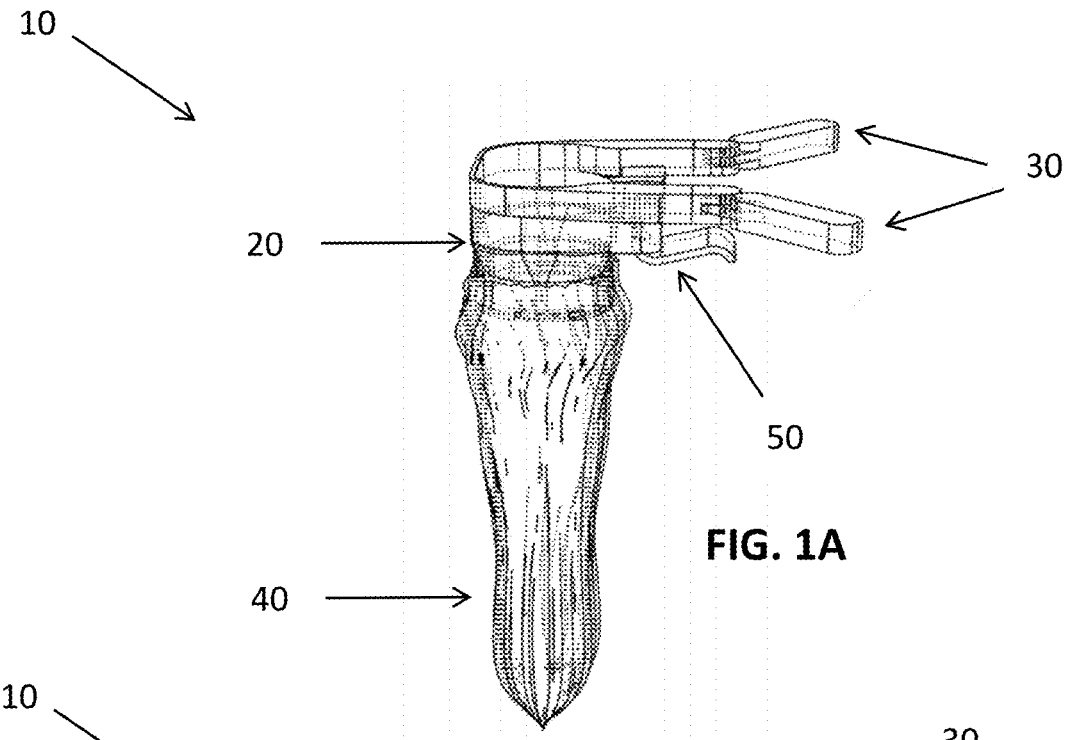
FIG. 1A shows a right side view of the assembled invention.

The drawings are intended to depict typical aspects of the invention. Specific components, designs and materials can be substituted or the layout rearranged and therefore should not be considered as limiting the scope of the invention. Like numbering represents like elements between the drawings.

The invention includes a collection bag 40 with one end open and a method of closure which may include a drawstring or an internal elastic band as shown in this embodiment. The bag is attached to the collection chute assembly 20 over the retainer ring 21 so that the drawstring or elastic on the open end of the bag can tighten against the collection chute assembly 20 without falling off during the tile collection process. The collection chute assembly 20 receives the playing pieces which are drawn to the device from the playing surface through the adjustable collection arms 30 attached with hinged joint 39 which are held against the playing surface by way of a retaining tension clip 50 which engages the underside of the playing surface.

In this embodiment, the adjustable collection arms 30 can be rotated from parallel to a 45° angle creating a "V" shaped channel through which the game pieces can be drawn to facilitate collection of game pieces. Adjustability of the collection arms 30 can prevent game pieces from becoming wedged in the throat of the collection chute assembly impeding flow and potentially dislodging the device from the playing surface. In other embodiments, the adjustable collection arms 30 might be rigidly fixed at some specific angle, creating a permanent "V" shaped funnel through which the game pieces could be drawn. In this embodiment, interchangeable retaining tension clips 53, 54, 55 are a formation of plastic, shaped to accommodate a variety of tabletop thicknesses and extension rims that may be found along the table edge. Three retaining tension clip styles 53, 54, 55 are detailed in this embodiment. In other embodiments, the retaining tension clip 50 could be a spring loaded element attached to the body of the collection chute assembly 20 using the indexing dovetail 51 and rest seat 52 to accommodate various table thicknesses.

The invention can be made from any material desired including a formed wire framework. In this embodiment, the device is constructed of plastic and the bag is made of cloth. In other embodiments, the device might be constructed of wrought wire with hinged or fixed wire arms and a wire retention element using rubber or plastic elements to improve retention to the playing surface.

DETAILED DESCRIPTION OF THE DRAWINGS

Turning to the drawings, the illustrative aspects of the invention are provided to describe the specific components of the In The Bag Tabletop Game Piece Collection and Storage Device.

Figure 1B:
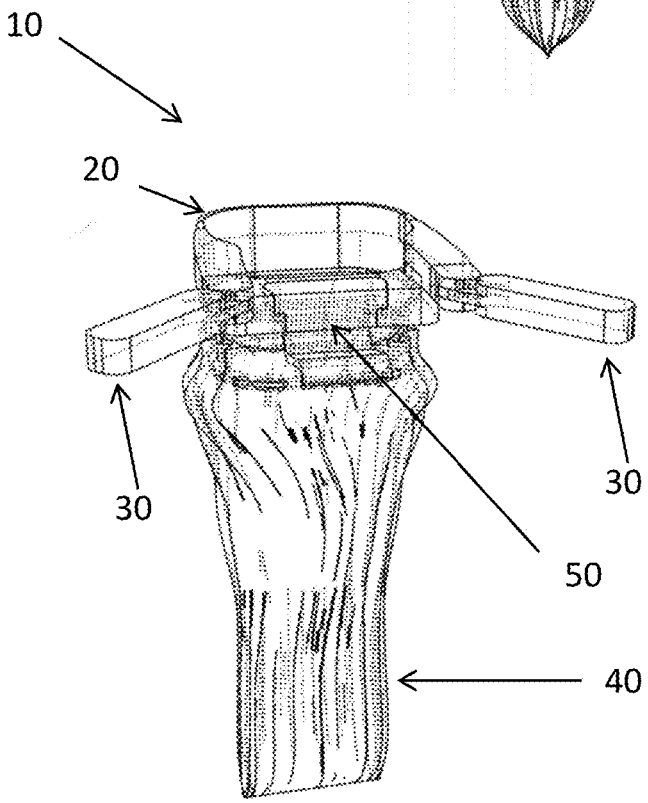
FIG. 1B shows a front view of the assembled invention.
Figure 1C:
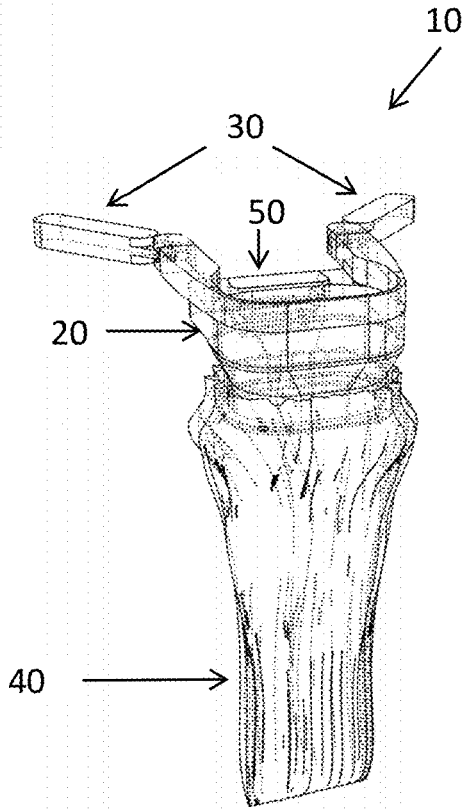
FIG. 1C shows a rear view of the assembled invention.

FIG. 1 depicts the assembled invention 10 from three different perspectives to demonstrate the various components. FIG. 1A shows a right side view, FIG. 1B shows a front view and FIG. 1C shows the rear view. The collection chute assembly 20 is fitted with two removable and adjustable arms 30 to facilitate collection of game pieces. A retaining tension clip 50 secures the device to the playing surface. The removable collection bag 40 is affixed to the bottom of the collection chute assembly 20.

Figure 2A:
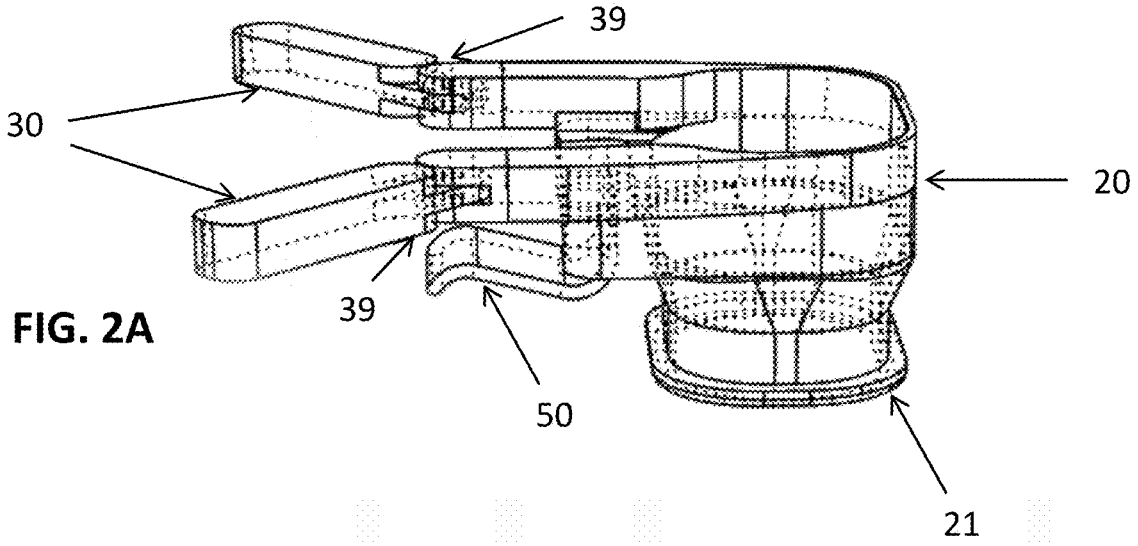
FIG. 2A shows a left side view of the collection chute assembly.
Figure 2B:
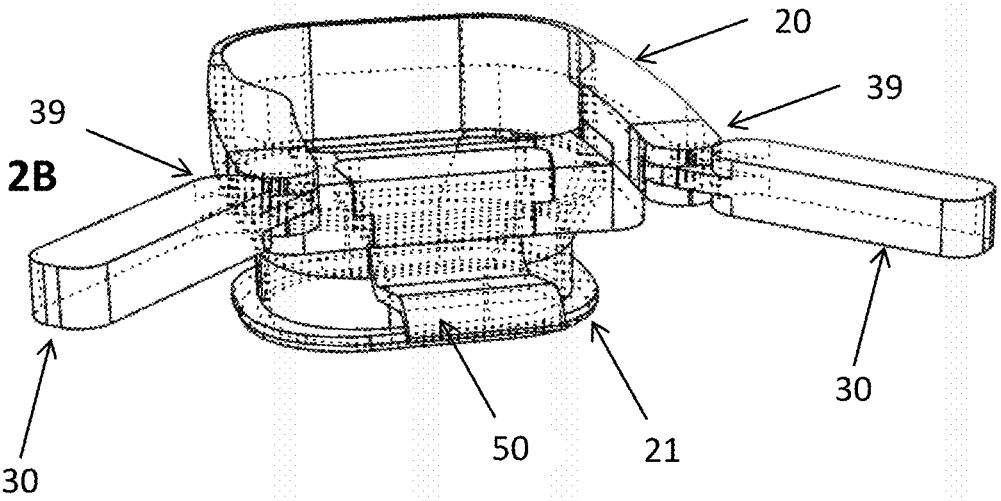
FIG. 2B shows a front view of the collection chute assembly.
Figure 2C:
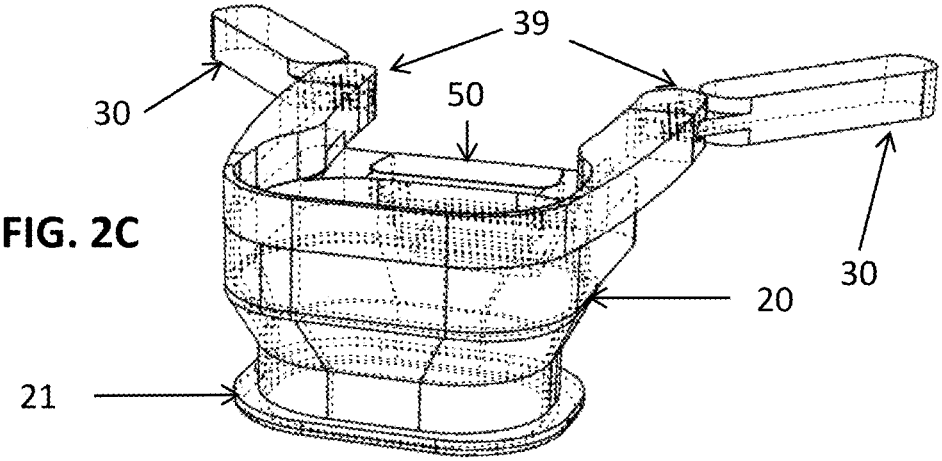
FIG. 2C shows a rear view of the collection chute assembly.

FIG. 2 depicts the invention from three different perspectives with the collection bag removed. FIG. 2A is a left side view FIG. 2B is a front view and FIG. 2C is a rear view. The hinge and ratchet joint 39 of the collection arms 30 to the collection chute assembly 20 is shown in the 45° position. Positioning of the retaining tension clip 50 is demonstrated. The collection bag retaining rim 21 at the bottom of the collection chute assembly 20 facilitates securing the removable collection bag 40 which has been removed for clarity.

Figure 3A:
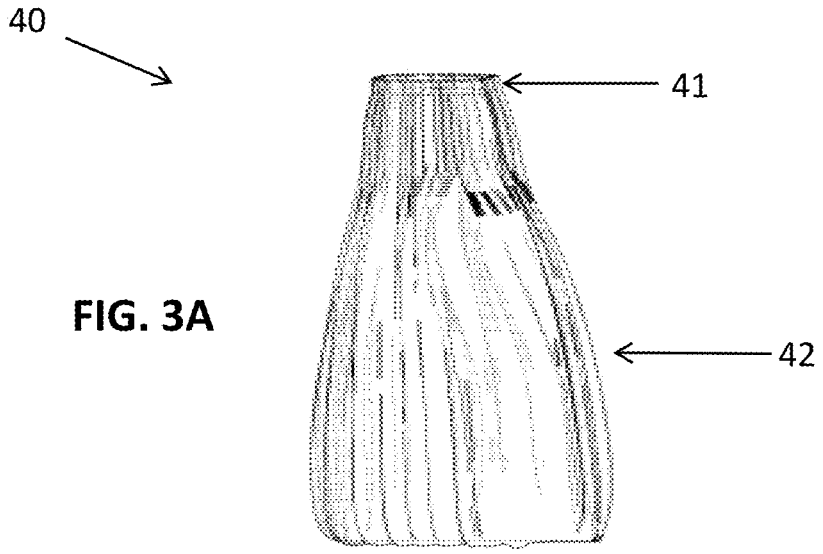
FIG. 3A shows a closed view of the collection bag.
Figure 3B:
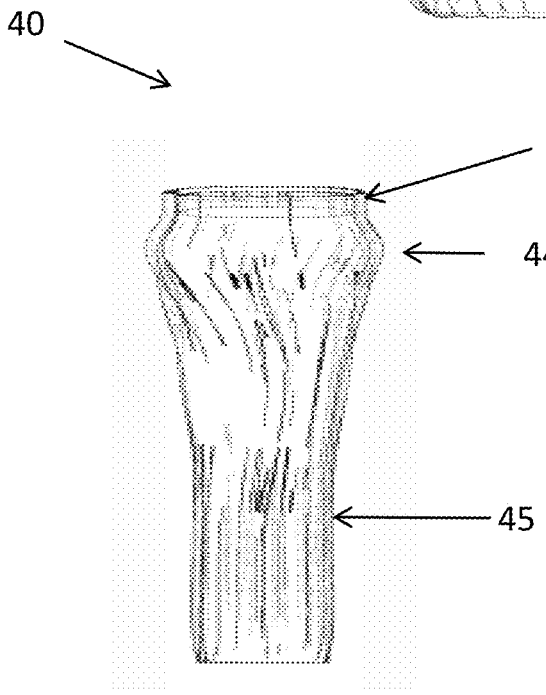
FIG. 3B shows a view of the collection bag as it would appear fitted to the device.
Figure 3C:
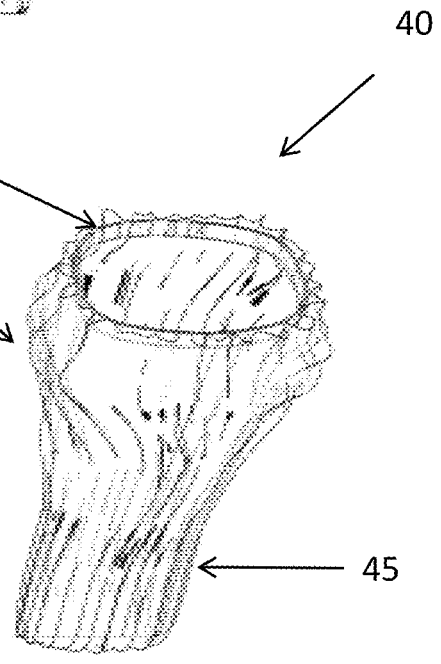
FIG. 3C shows a view showing the placement of the elastic closure band.

FIG. 3 identifies the removable collection bag 40. FIG. 3A depicts the bag in a closed position 41 and demonstrates the shape of the bag when filled with game pieces 42 as it would be when removed from the collection chute assembly 20. FIG. 3B demonstrates the empty bag configuration 45 the expanded configuration 44 over the collection bag retaining rim 21 and held in place with the elastic retention and closure band 43. FIG. 3C depicts the open throat of the bag to demonstrate the positioning of the elastic retention and closure band 43. In this embodiment the closure of the collection bag 40 is accomplished with an elastic band sewn into the bag, however, other embodiments might have other methods of fixation and closure such as a drawstring.

FIG. 4 depicts top views of the assembled invention 10 showing four different deployments of the adjustable arms 30 which are connected to the collection chute assembly 20 by means of the hinge and ratchet joint 39. These top views demonstrate the placement of the retaining tension clip 50 and the path of the game pieces through the open collection arms 30 and the opening of the collection bag 40. FIG. 4A shows the collection arms 30 in a parallel position, FIG. 4B shows both collection arms 30 deployed 15° for a 30° open angle, FIG. 4C shows a 30° deployment for a 45° open angle and FIG. 4D demonstrates 45° deployment for a 90° open angle.

Figures 5A, 5B, 5C, 5D:
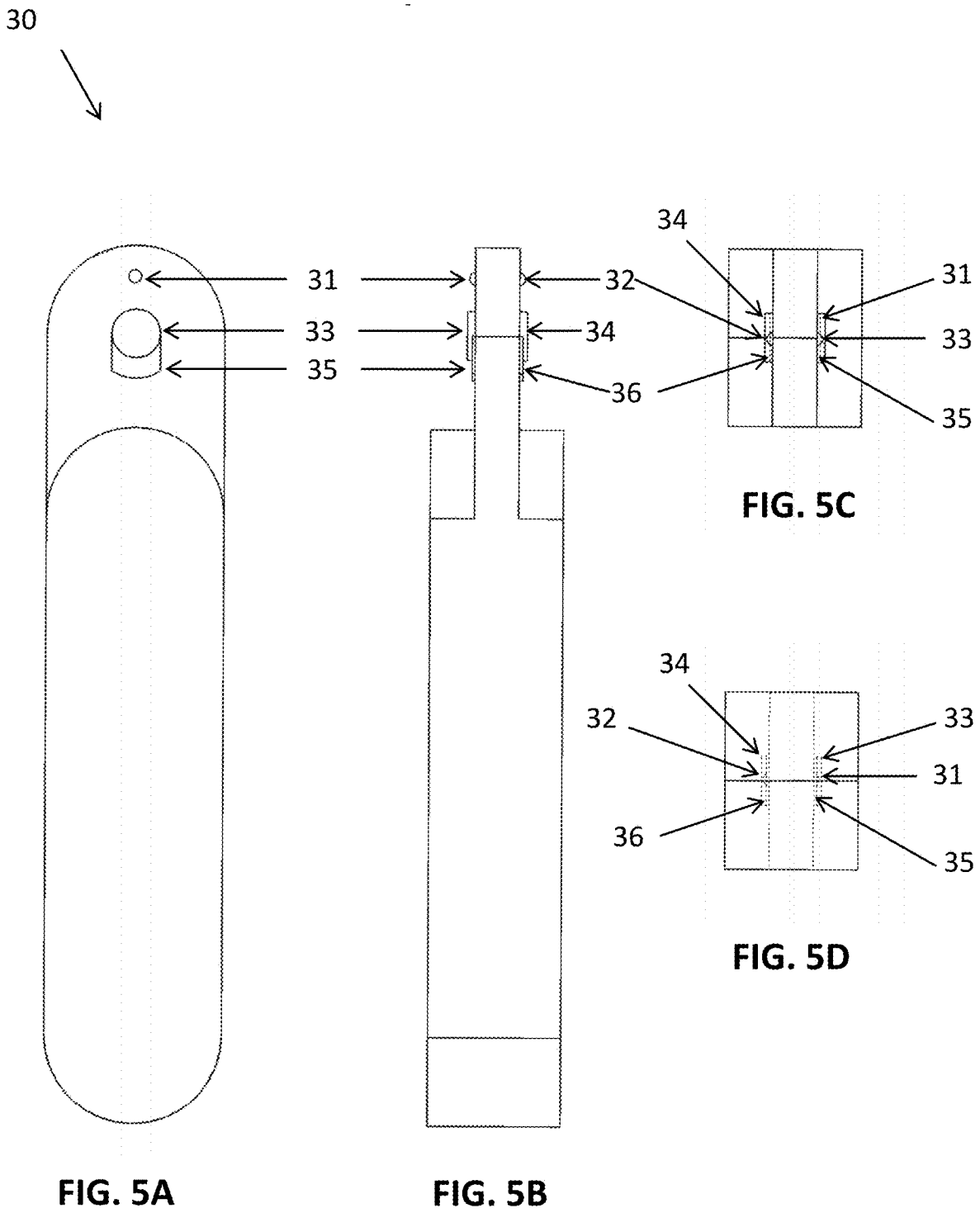
FIG. 5A shows a top view of a collection arm.
FIG. 5B shows a side view of a collection arm.
FIG. 5C shows a joint end view of a collection arm.
FIG. 5D shows a free end view of a collection arm.

FIG. 5 identifies the elements of the collection arms 30. FIG. 5A and FIG. 5B show the top/bottom views of the arms which are the same on each side. The upper and lower guide tabs 35, 36 aid in insertion of the collection arm 30 into the receptacle on the collection chute assembly 20 to engage the upper and lower pivot shafts 33, 34 and the upper and lower indexing nipples 31, 32. FIG. 5C is a view from the component end and FIG. 5D is a view from the closed end of the collection arm 30.

Figure 6A:
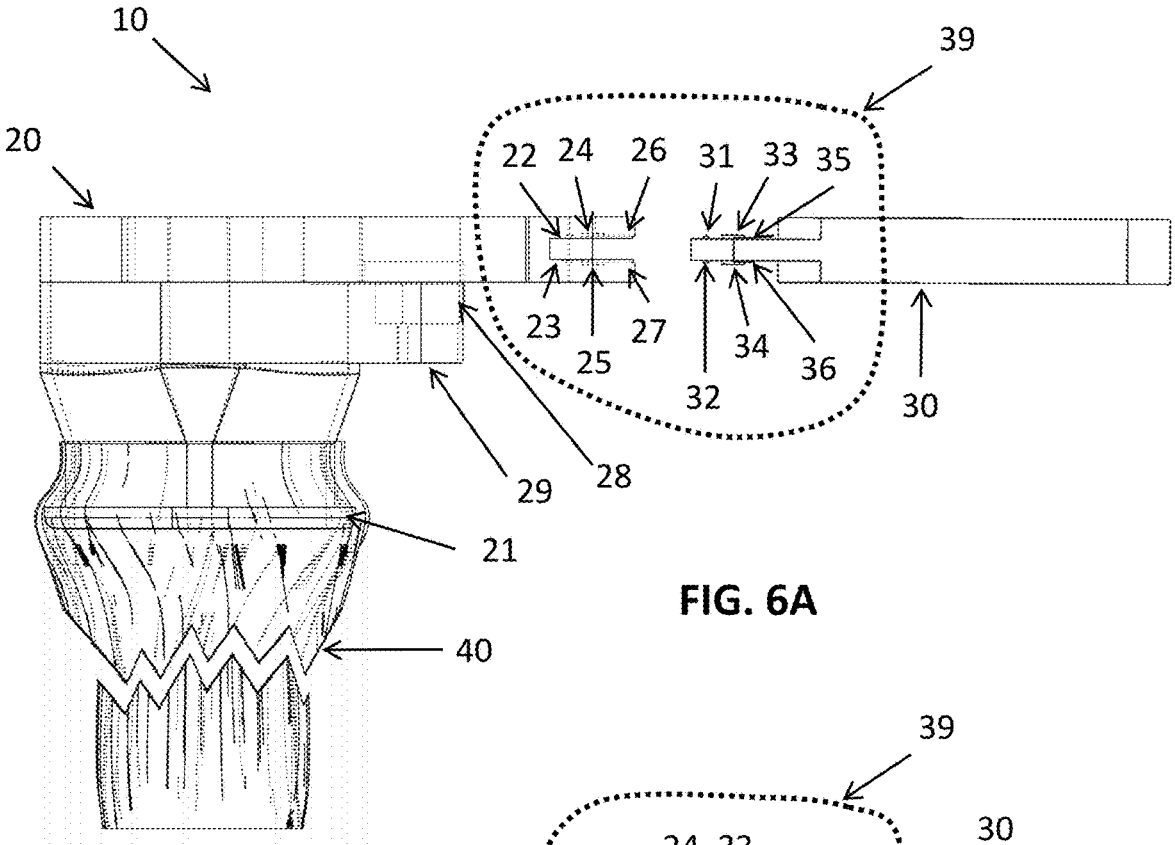
FIG. 6A shows a side view of the alignment of a collection arm to the collection chute.
Figure 6B:
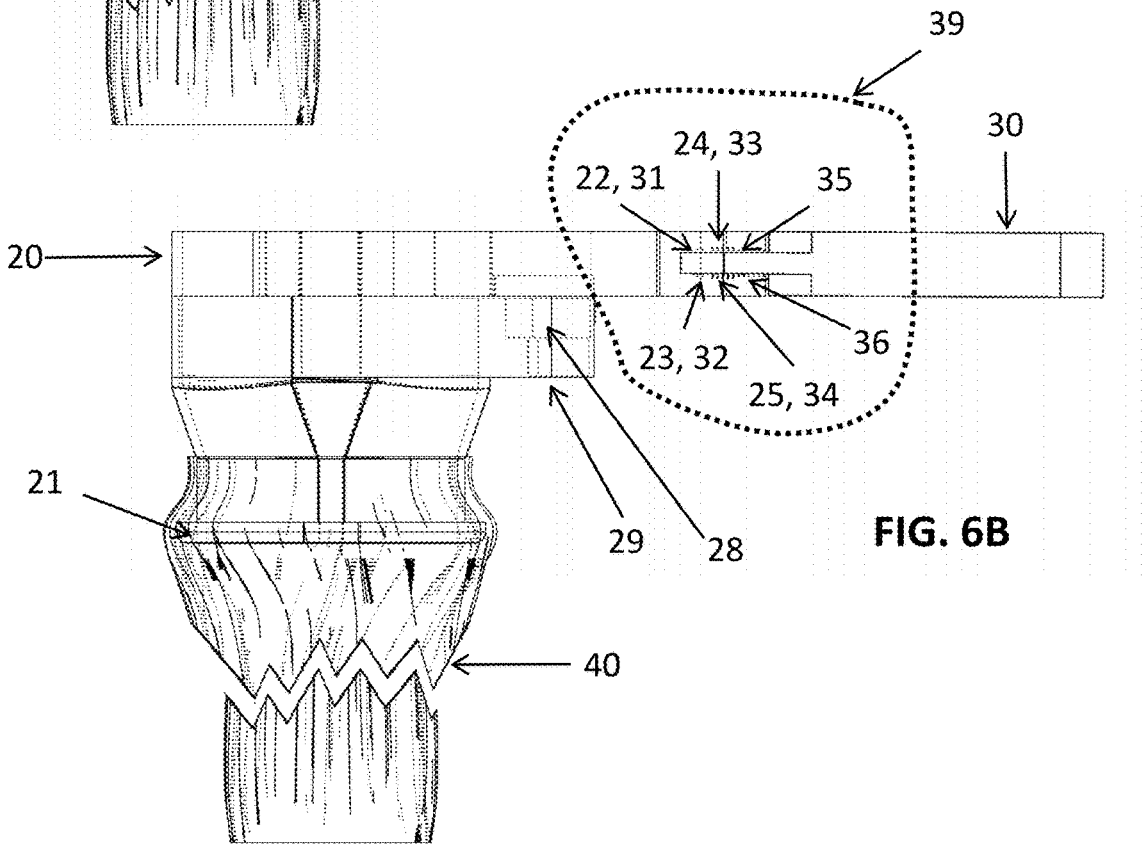
FIG. 6B shows a side view of the engagement of a collection arm with the collection chute.

FIG. 6 identifies the components of the assembled invention 10 in a right side view detailing the attachment of the collection bag 40, collection bag retaining rim 21, indexing receptacle 28 and seat 29 for the retaining tension clip 50. The components of the hinge and ratchet joint 39 attached to the collection chute assembly 20 and the collection arms 30 are detailed. FIG. 6A shows the disassembled collection arms 30 and FIG. 6B demonstrates the assembled hinge and ratchet joint 39.

The upper and lower guide channels 26, 27 of the collection chute 20 receive the upper and lower guide tabs 35, 36 of the collection arms 30. These tabs orient the upper and lower pivot shafts 33, 34 of the collection arms 30 to seat into the pivot receptacles 24, 25 of the collection chute 20 and the upper and lower index nipples 31, 32 of the collection arms 30 to engage the upper and lower index dimples 22, 23 of the collection chute 20.

FIG. 7 shows cross section details of the device. FIG. 7A is a right side view of the collection chute assembly 20, collection bag retaining rim 21, and collection bag 40. FIG. 7A identifies cross section views at various levels to provide details of the hinge and ratchet joint 39 and the indexing receptacle 28 and seat 29 for the retaining tension clip 50.

The components of the upper hinge and ratchet joint FIG. 6 (39) housed within the collection chute assembly 20 are shown in FIG. 7B which includes the upper guide channels 26, the upper pivot receptacles 24 and the upper index dimples 22. The lower guide channels 27, the lower pivot receptacles 25 and the lower index dimples 23 are shown in FIG. 7C which also identifies the indexing receptacle 28 and seat 29 for the retaining tension clip 50, the collection bag retaining rim 21, and collection bag 40.

The upper and lower index dimples 22, 23 are arranged to allow for 15° steps in the rotation of the collection arms 30 from center/parallel outward. Once seated, the pivot receptacles 24, 25 limit the rotation of the collection arms 30 to a maximum of 45° outward from the center line and prevent the removal of the collection arms 30 unless they are in the parallel position. The step positions of the arms are detailed in FIGS. 4A-4C.

Additional details of the indexing receptacle 28 and seat 29 for the interchangeable retaining tension clips 50 are shown in FIG. 7D and FIG. 7E. The dovetail shape of the indexing receptacle 28 prevents the retaining tension clips 50 from becoming dislodged and the seat 29 is designed to hold the retaining tension clips 50 slightly below the surface of the table top so that the playing pieces do not get caught on a ledge when being gathered into the collection chute 20.

Figure 8A:
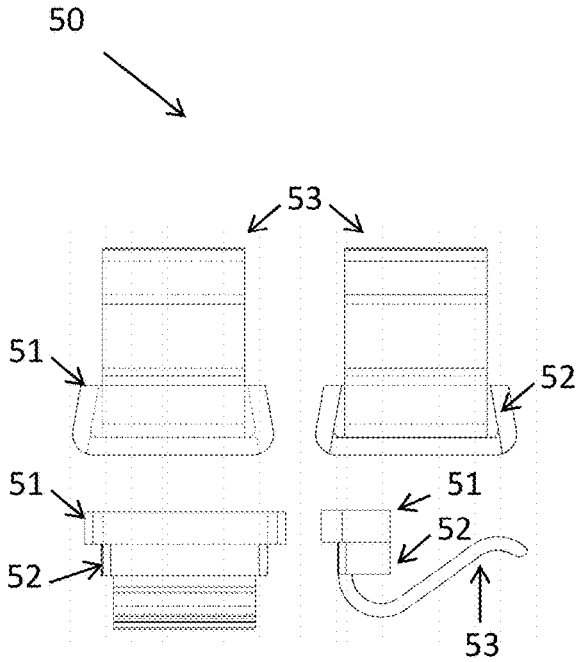
FIG. 8A shows the detail of the ½" table top retention clip.
Figure 8B:
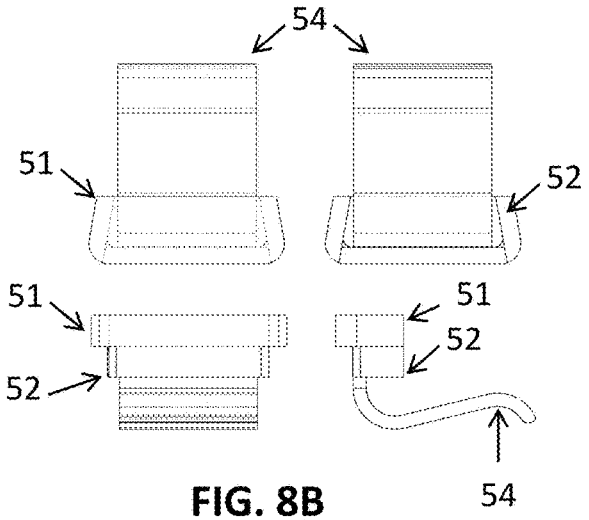
FIG. 8B shows the detail of the ¾" to 1¼" table top retention clip.
Figure 8C:
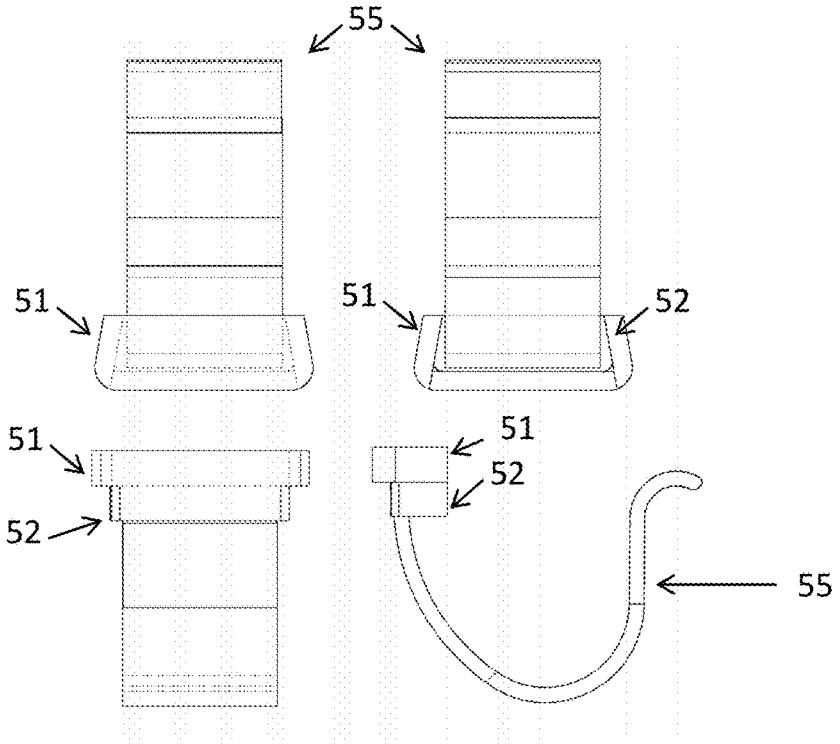
FIG. 8C shows a detail view of the skirted table top retention clip.

FIG. 8 is a detail of the three retaining tension clips 50 in this embodiment that are designed to accommodate various table thicknesses and configurations. FIG. 8A details the small retaining tension clip 53 for a table top thickness up to ½". FIG. 8B details the medium retaining tension clip 54 for a table top of thickness ¾" to 1¼". FIG. 8C details the large retaining tension clip 55 for a table top thickness of ½" to 1 inch with a skirt of up to 2 inches. Each of these is attached to the indexing dovetail 51 and rest seat 52 for interchangeability depending upon the playing surface. In other embodiments, other types of retaining clips could be used which might include a spring tension clip or an adjustable thumbscrew or other fixation devices. The connection platform of the indexing dovetail 51 and rest seat 52 could be attached to these or other fixation methods.

Figure 9A:
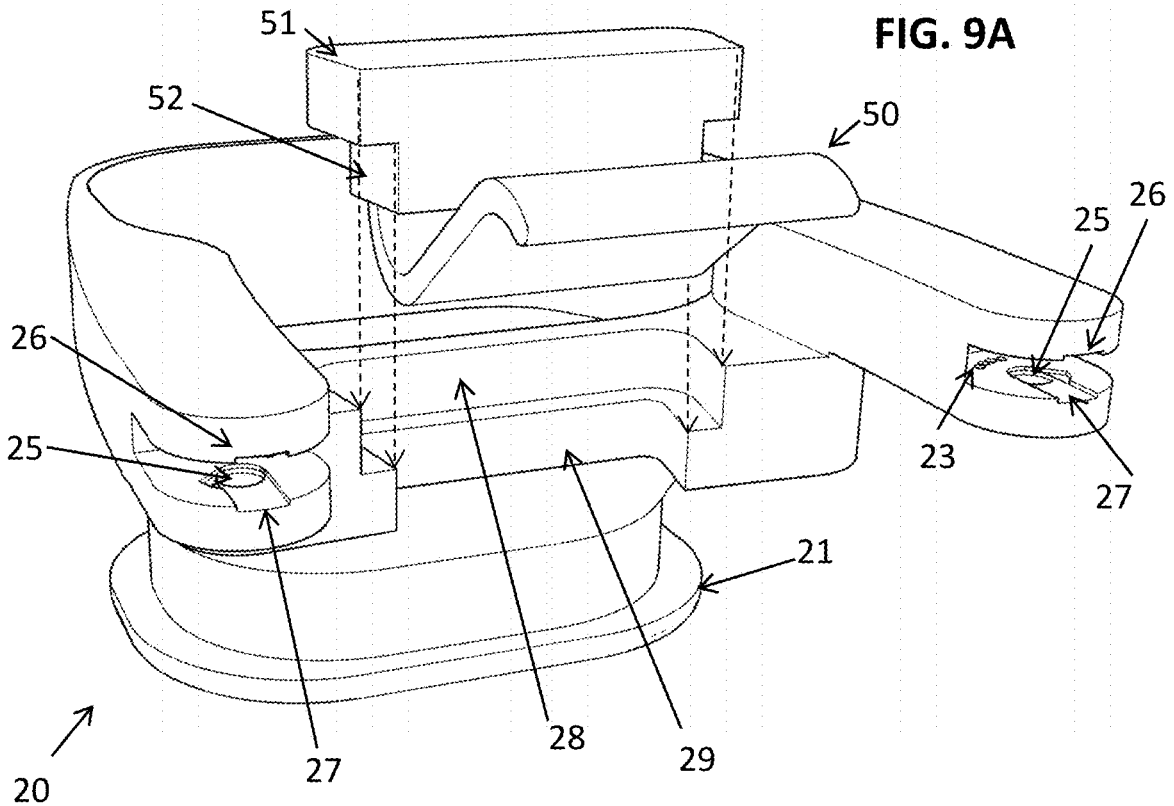
FIG. 9A shows the insertion path of a typical table top retention clip.
Figure 9B:
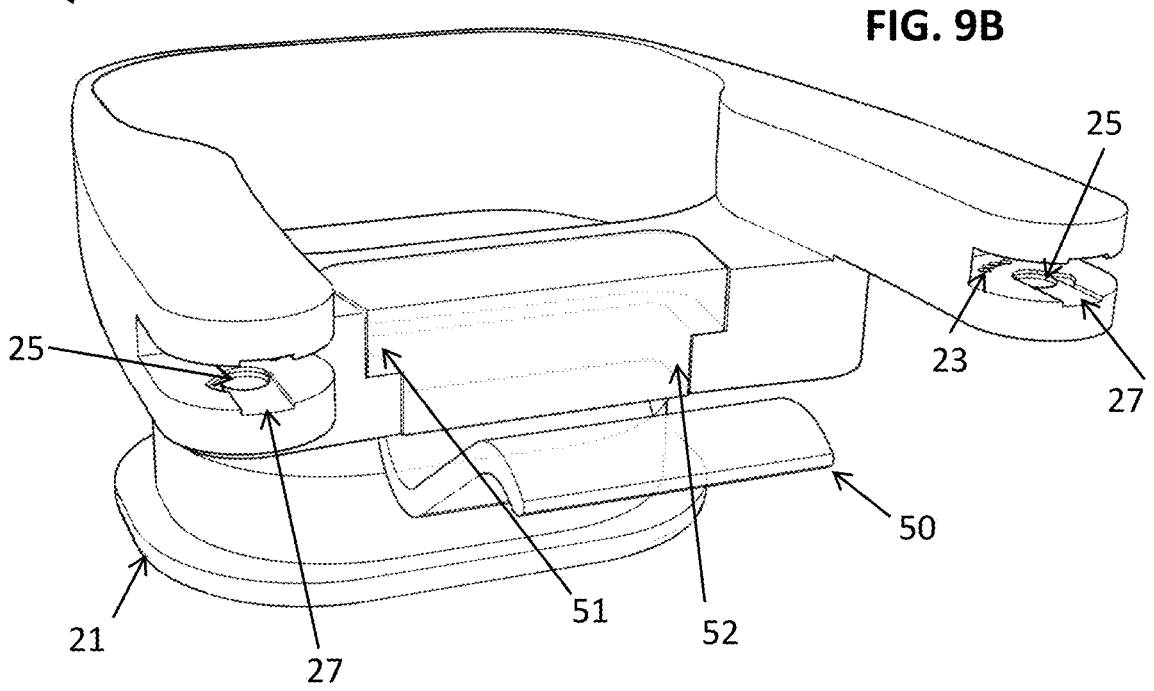
FIG. 9B shows the engaged of a typical table top retention clip.

FIG. 9 identifies the elements of the collection chute 20 which include the collection bag retaining rim 21 the lower index dimples 23 the upper and lower guide channels 26, 27 and the lower pivot receptacles 25. FIG. 9A further details the insertion path of the generic retaining tension clip 50 indexing dovetail 51 and rest seat 52 into the indexing receptacle 28 and the seat 29. FIG. 9B demonstrates the position of the fully seated retaining tension clip 50. Pressure from the retaining tension clips 50 against the underside of the playing surface serves to keep the clips fully seated.

Figure 10A:
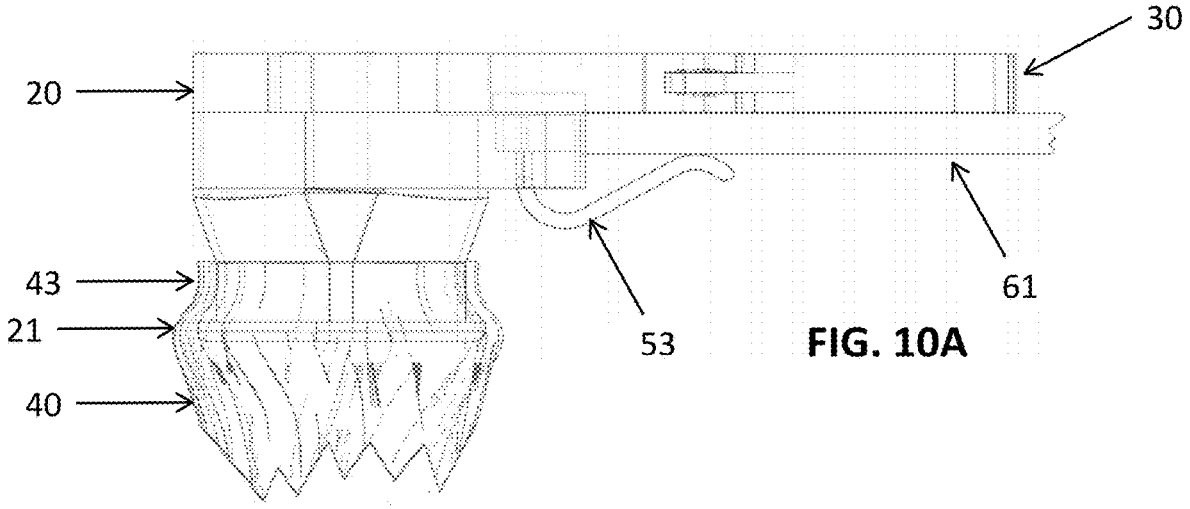
FIG. 10A shows the placement of the small table top retention clip on a ½" table surface.
Figure 10B:
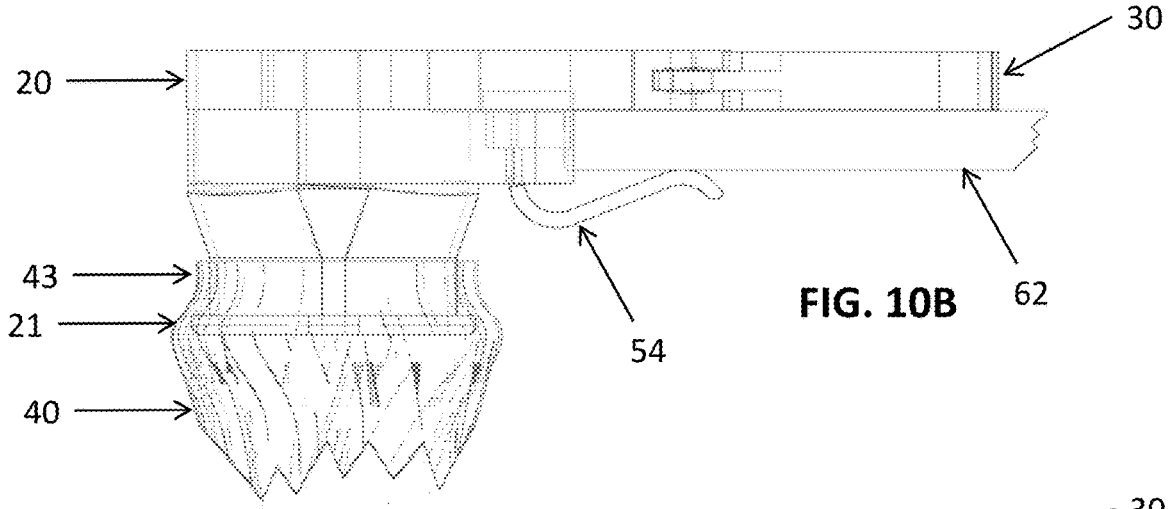
FIG. 10B shows the placement of the medium table top retention clip on a 1" table surface.
Figure 10C:
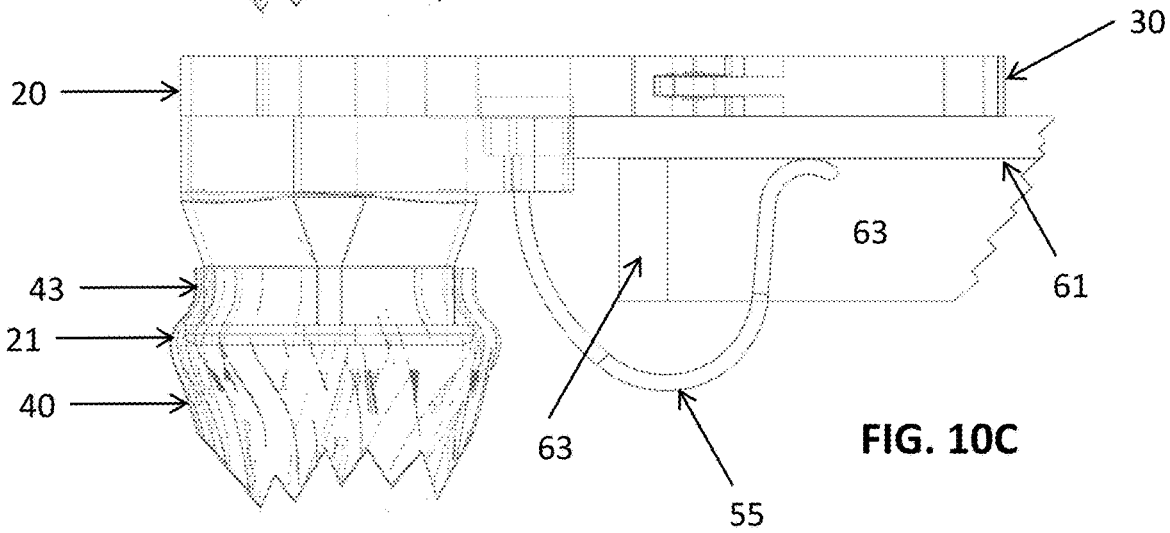
FIG. 10C shows the placement of the large table top retention clip on a skirted table surface.

FIG. 10 identifies the assembled invention in place on playing surfaces of varied thicknesses. In this embodiment, the collection bag 40 is held to the collection chute 20 with the elastic retention and closure band 43 and the support of the collection bag retaining rim 21. The collection arms 30 rest on the playing surface 61, 62, 63 while tension is applied with the retaining tension clips 53, 54, 55. The small retaining tension clip 53 on a table top thickness of ½" 61 is demonstrated in FIG. 10A. The medium retaining tension clip 54 on a table top thickness of ½" 62 Is shown in FIG. 10B. The large retaining tension clip 55 on a table top thickness of ½" 61 with a 2" skirt 63 is detailed in FIG. 10C. In other embodiments additional retaining tension clip 50 designs might accommodate other playing surface configurations.

Figure 11:
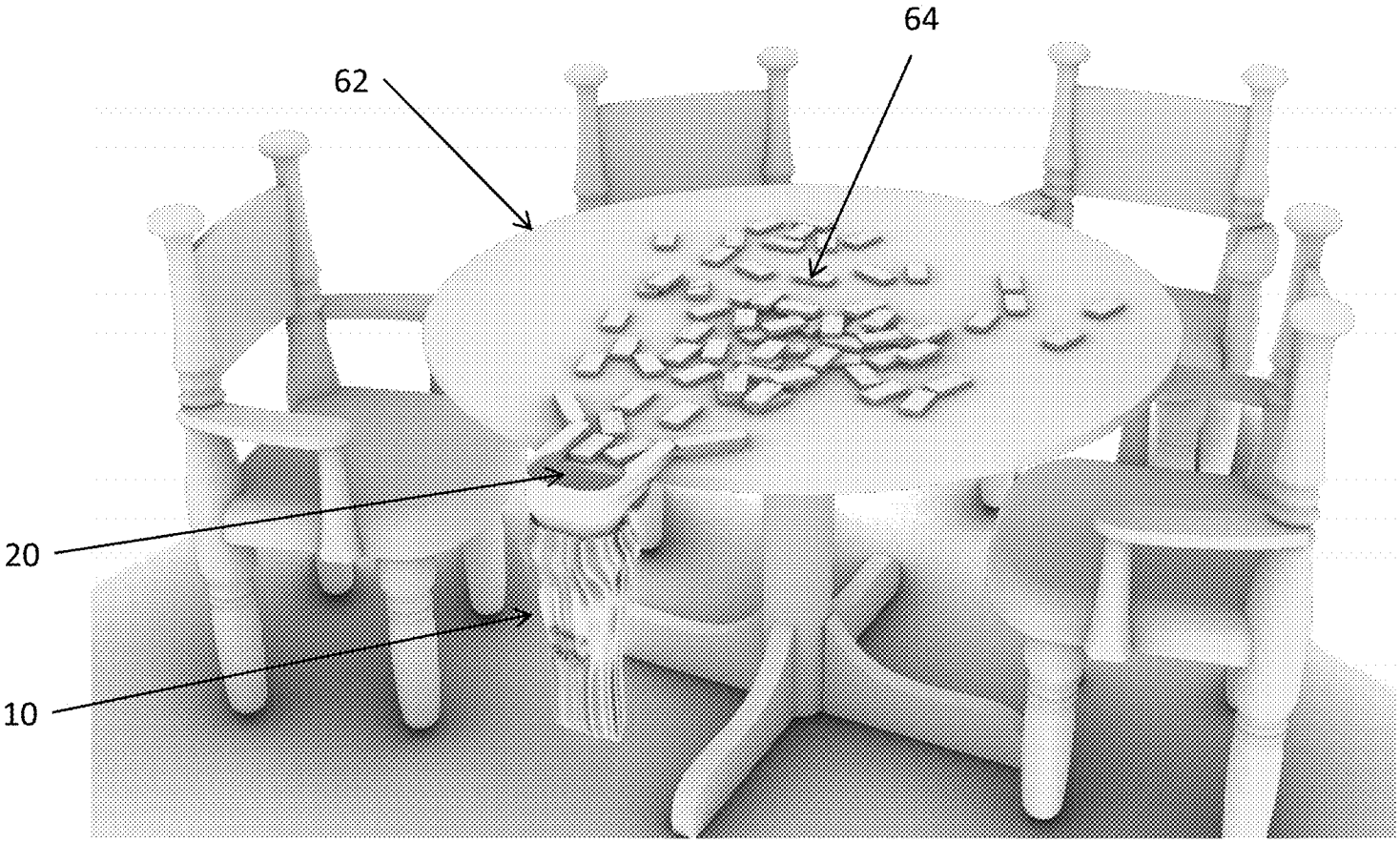
FIG. 11 shows an example of the device in place on a round table top playing surface.

FIG. 11 demonstrates a potential installation and usage of the invention 10 on a round playing surface 64 with the playing pieces 65 being gathered into the collection chute 20.

Usage of the Invention

The invention 10 is assembled by attaching the collection arms 30 to the collection chute 20 by aligning the collection arm 30 upper and lower guide tabs 35, 36 with the upper and lower guide channels 26 of the collection chute 20 and pushing until the upper and lower pivot shafts 33, 34 of the collection arm 30 engage the upper and lower pivot receptacles 24, 25 of the collection chute 20. Once seated, the upper and lower indexing nipples 31, 32 of the collection arm 30 engage the engage the upper and lower index dimples 22, 23 of the collection chute 20.

The collection bag 40 is attached to the collection chute 20 and the appropriate retaining tension clip 50 to fit the playing surface configuration desired is inserted into the indexing receptacle 28 and seat 29 of the collection chute 20. The assembled device is fitted to the edge of the playing surface as shown in FIG. 11. The collection arms 30 are adjusted to the desired opening angle in 15° increments. Once seated and adjusted, playing pieces are guided through the open collection arms 30 into the collection chute and will fall into the collection bag 40. Once all of the pieces are in the collection bag 40 the bag is removed and distributed among players for the selection of their playing pieces and continuation of play. Alternately, when play is completed, the pieces may be left in the bag for storage.

The description assembled here of various aspects of the invention has been presented for the purposes of illustration and description. Many modifications and variations are possible regarding the size, specific components and arrangement of those components, for example. The descriptions and drawings included herein are not intended to limit the invention to the precise form demonstrated or to be exhaustive. Modifications and variations which may be apparent to an individual skilled in the art are included within the scope of the invention as defined by the accompanying claims.

The descriptions and illustrations herein are a preferred embodiment of the invention along with a discussion of some of its variations. The descriptions, terms, and figures used herein are provided for illustration only and are not meant as specific limitations. Many variations are possible within the spirit and scope of the invention and this will be recognized by those skilled in the art. The following claims (and their equivalents) are intended to be defined by their broadest reasonable sense unless otherwise indicated. There shall be no legal or limiting effect of any headings utilized within the description which are for convenience only.

I claim:

1. A tabletop game piece collection and storage assembly device comprising:

a collection chute configured to be mounted to a tabletop, wherein the collection chute comprises adjustable collection arms; a slotted mechanism that retains and permits rotation of said adjustable arms; a plurality of interchangeable retention clips configured to mount the collection chute to the tabletop; a collection bag attached to the collection chute, wherein the collection bag is detachable from said collection chute; and wherein the plurality of interchangeable retention clips are configured for insertion into an indexing receptacle of the collection chute.

* * * * *